US011525655B1

(12) United States Patent
Vasudevan et al.

(10) Patent No.: US 11,525,655 B1
(45) Date of Patent: Dec. 13, 2022

(54) METHODS FOR EXTENDED-RANGE, ENHANCED-PRECISION GUN-FIRED ROUNDS USING G-HARDENED FLOW CONTROL SYSTEMS

(71) Applicant: Orbital Research Inc., Cleveland, OH (US)

(72) Inventors: Srikanth Vasudevan, Monroe, CT (US); Paul Suchy, Parma, OH (US); Matthew C. Birch, Madison, AL (US)

(73) Assignee: Orbital Research Inc., Cleveland, OH (US)

( * ) Notice: Subject to any disclaimer, the term of this patent is extended or adjusted under 35 U.S.C. 154(b) by 29 days.

(21) Appl. No.: 17/325,552

(22) Filed: May 20, 2021

Related U.S. Application Data

(63) Continuation of application No. 16/691,715, filed on Nov. 22, 2019, now Pat. No. 11,041,702, which is a continuation of application No. 15/911,265, filed on Mar. 5, 2018, now Pat. No. 10,520,291, which is a continuation of application No. 15/489,859, filed on Apr. 18, 2017, now Pat. No. 9,939,240, which is a continuation of application No. 15/188,093, filed on Jun. 21, 2016, now Pat. No. 9,658,040, which is a continuation of application No. 14/692,026, filed on Apr. 21, 2015, now Pat. No. 9,395,167, which is a continuation of application No. 13/769,560, filed on Feb. 18, 2013, now Pat. No. 9,086,258.

(51) Int. Cl.

| | |
|---|---|
| ***F42B 15/01*** | (2006.01) |
| ***F41G 7/22*** | (2006.01) |
| ***F42B 10/14*** | (2006.01) |
| ***F42B 10/42*** | (2006.01) |
| ***F42B 10/44*** | (2006.01) |
| ***F42B 10/62*** | (2006.01) |
| ***F42B 30/10*** | (2006.01) |

(52) U.S. Cl.
CPC ..... *F42B 15/01* (2013.01); *F41G 7/222* (2013.01); *F41G 7/2253* (2013.01); *F41G 7/2293* (2013.01); *F42B 10/14* (2013.01); *F42B 10/42* (2013.01); *F42B 10/44* (2013.01); *F42B 10/62* (2013.01); *F42B 30/10* (2013.01)

(58) Field of Classification Search
CPC ..... F42B 15/01; F42B 10/14; F42B 10/44; F42B 10/62; F42B 30/10
USPC ..... 102/490
See application file for complete search history.

(56) References Cited

U.S. PATENT DOCUMENTS 3,790,104 A * 2/1974 Jones ..... F42B 10/14 244/3.28
4,709,877 A * 12/1987 Goulding ..... F42B 10/64 244/3.28

(Continued)

*Primary Examiner* — Samir Abdosh
(74) *Attorney, Agent, or Firm* — Brian Kolkowski

(57) ABSTRACT

Methods involve using a guided munition (e.g., a mortar round or a grenade) that utilizes deployable flow effectors, activatable flow effectors and/or active flow control devices to extend the range and enhance the precision of traditional unguided munitions without increasing the charge needed for launch. Sensors such as accelerometers, magnetometers, IR sensors, rate gyros, and motor controller sensors feed signals into a controller which then actuates or deploys the flow effectors/flow control devices to achieve the enhanced characteristics.

20 Claims, 9 Drawing Sheets

(56) References Cited

U.S. PATENT DOCUMENTS

| | | | | |
|---|---|---|---|---|
| 4,838,502 | A * | 6/1989 | Pinson | F42B 10/42 244/49 |
| 5,379,968 | A * | 1/1995 | Grosso | F42B 15/01 244/3.21 |
| 6,073,880 | A * | 6/2000 | Voigt | F42B 10/14 244/3.28 |
| 9,086,258 | B1 * | 7/2015 | Vasudevan | F41G 7/2293 |
| 9,366,514 | B1 * | 6/2016 | Barnard | F42B 30/04 |
| 9,395,167 | B1 * | 7/2016 | Vasudevan | F41G 7/222 |
| 9,658,040 | B1 * | 5/2017 | Vasudevan | F42B 10/44 |
| 10,735,654 | B1 * | 8/2020 | Jankowski | F42B 10/02 |
| 2005/0040280 | A1 * | 2/2005 | Hua | F42B 15/01 701/3 |
| 2006/0272538 | A1 * | 12/2006 | Janik | F42B 5/067 102/439 |
| 2010/0133374 | A1 * | 6/2010 | Geswender | F42B 15/01 244/3.2 |
| 2013/0255527 | A1 * | 10/2013 | Levy | F42B 15/01 102/517 |
| 2020/0225311 | A1 * | 7/2020 | Slocum | F41G 7/2233 |

* cited by examiner

METHODS FOR EXTENDED-RANGE, ENHANCED-PRECISION GUN-FIRED ROUNDS USING G-HARDENED FLOW CONTROL SYSTEMS

CROSS-REFERENCE TO RELATED APPLICATION

This application is a continuation of U.S. patent application Ser. No. 16/691,715, which was filed on Nov. 22, 2019 and is a continuation of U.S. patent application Ser. No. 15/911,265, which was filed on Mar. 5, 2018 and issued as U.S. Pat. No. 10,520,291 on Dec. 31, 2019, and is a continuation of U.S. patent application Ser. No. 15/489,859, which was filed on Apr. 18, 2017 and issued as U.S. Pat. No. 9,939,240 on Apr. 10, 2018, and which is a continuation of U.S. patent application Ser. No. 15/188,093, which was filed on Jun. 21, 2016 and issued as U.S. Pat. No. 9,658,040 on May 23, 2017, and which is a continuation of U.S. patent application Ser. No. 14/692,026, which was filed on Apr. 21, 2015 and which issued as U.S. Pat. No. 9,395,167 on Jul. 19, 2016, and which is a continuation of U.S. patent application Ser. No. 13/769,560, which was filed on Feb. 18, 2013 and which issued as U.S. Pat. No. 9,086,258 on Jul. 21, 2015. The specifications and drawings of each of the above patents and applications are hereby incorporated by reference in their entirety.

STATEMENT REGARDING FEDERALLY-SPONSORED RESEARCH OR DEVELOPMENT

This invention was made with U.S. Government support under SBIR Phase I contract No. W15QKN-12-C-0100 and Extended Support Participants Program (ESPP) contract No. W15QKN-08-C-0012 awarded by U.S. Army, ARDEC, Picatinny Arsenal, N.J. The U.S. Government has certain rights in the invention.

BACKGROUND OF THE INVENTION

1. Field of the Invention

The present invention relates to g-hardened flow control systems and more specifically to flow control systems for grenade or mortar rounds fired out of short barrels necessitating very high firing or launch accelerations. The present invention further relates to grenade and mortar round flow control systems that act to improve the rounds' range and precision. The present invention further relates to a method of operating such a flow control system.

2. Technology Review

Short-barrel munitions, such as grenades and certain size mortars, experience high accelerations or setback loads during their firing or launch as a result of their having to reach their final launch velocity within a short amount of time. This firing or launch acceleration can be on the order of tens of thousands of g's, where one g is approximately equal to 9.80665 meters per second per second. For the purposes of this application, a "short barrel" is one of length between 9 inches to 12 inches when used to fire 40 mm grenades.

Traditional munitions of the type fired out of short-barrel guns are propelled by the ignition of powder charges which combust quickly inside the barrel, and such munitions are stabilized only by passive tail fins. Unlike rockets, which have continuous propulsion throughout flight, traditional munitions have a range limited by the charge combustion energy expended in the instant of firing, and unlike guided missile systems, have an accuracy and precision determined principally by the aim of the launch barrel, wind and air conditions, and whatever variations and imbalances may exist in the munition round. Range limitations, aim error and random or biasing disturbances may thus cause an unguided munition to be incapable of reaching a target or may require many rounds to strike suitably nearby the target owing to the large circular error probable (CEP), a measure of munition precision defined as the radius within which 50% of correctly aimed rounds may fall. Aside from the obviously undesirable outcome of missing an intended target, a round having insufficient range and/or CEP may inflict collateral damage which is also highly undesirable, particularly in urban warfare scenarios, and may put at risk the mortar firing crew for the duration of whatever excess time is needed to fire the increased number of rounds required for target saturation. By contrast, range extension and CEP enhancement permits the use of fewer rounds, directly translating into lowered logistical costs, speedier engagement resolutions and improved mission outcomes.

What is needed is a system that would increase both the effective range and the CEP of munition rounds fired from short barrels, without deviating from the caliber and general form factor of these traditional rounds so as not to obsolete standard issue mortars and grenade launchers. It is an object of the present invention to provide a system with one or more of these advantages over traditional grenades and mortar rounds.

The recent trend in gun-fired munitions development has been add guidance capability to small- and medium-caliber mortar rounds without directly addressing range limitations. The XM395 Precision Guided Mortar Munition (PGMM), a 120 mm guided mortar round produced by Alliant Techsystems (ATK), uses fixed canards mounted to a rotating nose spun counter to the spin of the round body (which is made to spin by means of canted tail fin extensions) to direct the mortar round in flight and correct its course to a target. A similar design mortar round by BAE Systems and General Dynamics Ordnance and Tactical Systems (GD-OTS), the 81 mm or 120 mm Roll Controlled Guided Mortar (RCGM), uses curved or airfoil-shaped canards on a collar that is spun counter to the spin of the round body (which, again, is made to spin by means of canted tail fin extensions) to direct the mortar round in flight and correct its course to a target. ATK's rounds have reportedly demonstrated a CEP of less than 10 meters at ranges in excess of 6,500 meters while rounds using the BAE/GD-OTS approach reportedly achieved an average miss distance of roughly 7 meters at ranges between 980 and 4,000 meters in firing tests done in 2012.

These experimental technologies have been very promising but still have the drawback of inherent limited range of the mortar round to the distance that can be achieved of an ordinary ballistic path given the velocity of the round at the time of gun expulsion. Range can be improved with these approaches by use of greater amounts of firing charge but even this is limited both by the spatial volume available for charge packages and by the amount of acceleration (setback load) the round can tolerate on firing given the g-force sensitivity of its sensor, processor, and braking components.

Additionally, the technologies currently being developed for mortar rounds have limited applicability to smaller rounds such as fired grenades.

What is needed is a system capable of providing both extended range and enhanced precision to gun-fired munitions. What is also needed is a system capable of providing reduced circular error probable (CEP), enabling a target to be effectively attacked with fewer rounds. What is also needed is a technology which could be applicable to high-g munitions of various calibers and sizes, including mortar rounds and grenades. What is also needed is a system capable of providing a larger maneuver footprint for fin-stabilized munitions of every caliber. It is an object of the present invention to provide a system with one or more of these advantages over the traditional systems and the systems described above.

Achieving these goals in a guided munition round inherently adds cost to the round. Whatever approach is taken, it cannot be ultimately more expensive than traditional approaches, all costs accounted for. Naturally, the externalities of collateral damage caused by inaccurate unguided munitions should be factored into the economic analysis, but preferably, the improvements made in a guided munition do not add so much cost to the munition as to make them prohibitively expensive, or even more expensive overall than unguided munitions even without the costs of externalities accounted for. The improved munition should also be as simple to use and as low-waste as possible.

What is needed, therefore, is a system capable of extending range and enhancing precision of high-g munitions in a sufficiently low-cost manner such that the new range and precision capabilities of the weapon more than compensate for the additional cost of the round, without the use of complicated and wasteful sabots. The present invention achieves these goals by making innovative use of both traditional and novel control technologies.

SUMMARY OF THE INVENTION

The present invention relates to improvements to gun-fired projectiles launched from short barrels and which experience high firing/launch accelerations (setback loads) of upwards of 10,000 g's. More specifically, the present invention relates to control systems for grenade rounds and mortars that are deployed and/or actuated during the grenade round or mortar's flight to extend range and/or improve precision. For the sake of simplicity in describing the invention in this patent application, the grenade rounds and mortar rounds of the present invention will be collectively referred to as "rounds," with the understanding that the use of this word does not connote any projectile, system or device broader than gun-fired explosive rounds that experience high g's on firing or launch (i.e., more than 10,000 g's).

Setback load is the load seen on the projectile at launch/gun-fire event. It is the acceleration of the projectile opposing the direction of motion of the projectile. Setback load survivability of high-g munitions is a difficult engineering problem. Components in a round, and particularly those fragile components associated with control, such as motors, servos, control surfaces, and computer processors, must be mounted so as to have absolute stillness relative to each other on launch. Otherwise, these components can move with respect to each other with great energy on launch and damage each other.

Several different embodiments of the invention are envisioned. Some embodiments involve deployable or activatable flow effectors placed on a munition round which are controlled by a sensor-fed processor to steer the munition round and/or extend its range. The invention may also be embodied by one or more of the sensor, controller, or flow effector subsystems of such a munition.

In some embodiments the systems of the present invention utilize activatable flow effector or active flow control devices. The activatable flow effectors or active flow control devices of the present invention are unconventional flow surfaces that are electromechanical, electropneumatic, electrohydraulic, fluidic, and other types of devices, which can be used to create disturbances in the flow over the surface of the missile or aircraft. In some instances, preferably, the activatable flow effector or active flow control devices induce small disturbances, micro-vortices or perturbances in the vicinity or close proximity to the activatable flow effector or active flow control device. Further preferably, the activatable flow effector or active flow control device is flush or nearly flush, when deactivated, with the surface of the missile or aircraft to which it has been installed thereby creating little or no drag on the missile or aircraft when in an inactive state. In some instances, it is preferred that the activatable flow effector or active flow control devices have no hinged parts or surfaces. The activatable flow effector or active flow control devices of the present invention include but are not limited to active vortex generators, which are deployable, including but not limited to flow deflectors, balloons, microbubbles, and dimples or create active pressure active regions by suction or air pressure; synthetic jets including zero-net-mass synthetic jets; pulsed vortex generators; directed jets; vortex generating devices (fluidic and mechanical) plasma actuators including weakly ionized plasma actuators and single barrier dielectric discharge actuators; wall turbulators; porosity including but not limited to reconfigurable, inactive and active; microactuators; and thermal actuators.

The deployable flow effectors of the present invention may include deployable wings, canards, strakes, spoilers, body fins, tailfins/vertical stabilizers, tailplanes/horizontal stabilizers, and winglets. For the purposes of this application, these structures must be construed to have mutually exclusive meanings. For example, a canard is a forward-placed structure and/or control surface, oriented horizontally or at some small angle therefrom, placed ahead of a wing (or, in any case, forward of the center of gravity, where a wing would be) instead of behind it on an afterbody or tail, and is thus distinguished from a tailplane/horizontal stabilizer or a fin. These structures may comprise or may act as flaps, rudders, elevators, elevons, ailerons, and/or stabilators, as appropriate, each of which terms has a separate and distinct meaning in the art from the other terms and should not be blurred or confused when used in this application to claim or define certain structures. A person skilled in the art would appreciate that the named structures all function differently.

The systems of the present invention utilize a range of sensors for maneuvering or stabilizing the round during flight. The sensors, for example, may be used to determine the round's relative position with respect to a moving target or target location, the flow dynamics on the round's flow surface, and threats or obstacles in or around the round. The sensors for determining the round's relative position may include but are not limited to antennas for acquiring global positioning (GPS), magnetic sensors, solar detectors, an inertial measurement unit (IMU), and the like. The sensors for determining the flow dynamics may include but are not limited to a static and/or dynamic pressure sensor, shear stress sensor (hot film anemometer, a direct measurement floating-element shear stress sensor), inertial measurement unit or system, and other sensors known to those skilled in the art whose signal could be used to estimate or determine flow condition such as separation on the surface of the round, which would function as a trigger point for actuating the activatable flow effectors or active flow control devices or deploying the deployable flow effectors. The sensors for determining threats or obstacles in or around the aircraft or missile include but are not limited to radar detectors, laser detectors, chemical detectors, heat (or infrared) detectors, and the like. The sensors most useful for determining round flight parameters include accelerometers, magnetometers, IR sensors, rate gyros, and motor controller sensors.

The controller is described in more detail in the detailed description. The controller can be predictive or can respond and actuate the activatable flow effectors or deploy the deployable flow effectors based on current conditions. The controller preferably utilizes one or more digital microprocessors to process signals provided by the various sensors and deliver deployment, activation, or actuation commands to the deployable flow effectors, activatable flow effectors or active control surfaces of the present invention.

Some embodiments of the invention comprise a grenade, mortar round or tank round having a forebody and an afterbody, tailfins on the afterbody, and at least one deployable flow effector, activatable flow effector or active flow control device forward of and in alignment with at least one of the tailfins, such that deployment or activation of the flow effector affects the flow of air around the tailfin to steer or maneuver the round. The spoiler or flow effector when deployed is to augment momentum mixing using passive or low frequency excitation, which enhances the boundary layer and subsequently the downstream flow structures. In the case of a forebody device, the actuator (strake) has been shown to act as a "vortex generator," which can be used to control forebody asymmetries and yawing moment at high angles of attack. In the case of an aftbody, the actuator (spoiler) has been shown to act as an "aero-brake," which can be used to generate pitching and yawing moments at low angles of attack. Preferably, the grenade, mortar round or tank round is fin stabilized and/or is shot out of a smooth-bore mortar, barrel, cannon or tube. Preferably, the mortar, barrel, cannon or tube is a short barrel. Preferably, the tailfins are deployable, and further preferably, when deployed, the tailfins extend beyond the caliber diameter of the round shell. Preferably, the deployable flow effector, activatable flow effector or active flow control device of this embodiment is a spoiler, but it might be, in various embodiments, any of the other effectors, devices or surfaces described elsewhere in this application. Preferably, the deployable flow effector, activatable flow effector or active flow control device of this embodiment is deployed and/or actuated on the command of a controller which has been programmed to process inputs from one or more sensors, including those listed above. In some such embodiments the grenade or mortar round further comprises deployable canards and preferably deployable, independently actuatable canards that act to steer the round during flight. Further preferably, these canards extend beyond the caliber diameter of the round shell. Also preferably, the grenade, mortar round or tank round has one or more mechanical or electrical components, including sensors, actuators and/or processors that have been g-hardened to survive the firing or launch impulse as described elsewhere in this application.

Other embodiments of the present invention comprise a munition round having a forebody, a midbody and an afterbody, tailfins on the afterbody, and deployable wings on the midbody. Preferably, the deployable wings are configured to deploy at dihedral angles. Also preferably, the munition round further comprises deployable, actuatable canards capable of generating lift on the munition round forebody during flight sufficient to lift the nose of the munition round and, in conjunction with the lift provided by the wings, cause the round to glide in departure from a traditional ballistic arc, thereby extending the range of the munition round. Preferably, the canards are independently actuatable such that they are capable of inducing roll in the munition round to steer it to a target. Preferably, the munition is a 120 mm mortar round. Preferably, the munition round is fin stabilized and/or is shot out of a smooth-bore mortar, barrel, cannon or tube. Preferably, the mortar, barrel, cannon or tube is a short barrel. The tailfins may be fixed or deployable or both (meaning, in the latter case, that the deployment extends, enlarges or cants the tailfins). Further preferably, the deployable wings and/or canards extend beyond the caliber diameter of the round shell. Also preferably, the grenade, mortar round or tank round has one or more mechanical or electrical components, including sensors, actuators and/or processors that have been g-hardened to survive the firing or launch impulse as described elsewhere in this application. Most preferably, this g-hardened component should be capable of surviving a firing or launch acceleration (setback load) of 16,000 g's.

Still other embodiments of the present invention comprise a munition round having a forebody and an afterbody, deployable tailfins on the afterbody, and deployable and actuatable canards on the forebody. Preferably, the canards are capable of generating lift on the munition round forebody during flight sufficient to lift the nose of the munition round and cause the round to glide in departure from a traditional ballistic arc, thereby extending the range of the munition round. Preferably the canards are independently actuatable such that they are capable of inducing roll in the munition round to steer it to a target. Preferably, the munition is a 40 mm grenade. Preferably, the munition round is fin stabilized and/or is shot out of a smooth-bore mortar, barrel, cannon or tube. Preferably, the mortar, barrel, cannon or tube is a short barrel. The tailfins may be fixed or deployable or both (meaning, in the latter case, that the deployment extends, enlarges or cants the tailfins). Further preferably, the deployable canards extend beyond the caliber diameter of the round (i.e., they are "supercaliber" when deployed). The span of the canard should be sufficiently long enough to be in the free stream flow (outside the boundary layer). This helps as a significant portion of the canard will then be present in the free stream—where the flow is expected to be clean (not turbulent). Also preferably, the grenade, mortar round or tank round has one or more mechanical or electrical components, including sensors, actuators and/or processors that have been g-hardened to survive the setback load as described elsewhere in this application. Most preferably, this g-hardened component should be capable of surviving setback loads of 18,000 g's.

Still other embodiments of the present invention comprise a short-barrel gun-fired munition comprising at least one activatable flow effector for extending the range and enhancing the precision of the munition, wherein the munition is fired from a short-barrel gun and experiences a launch or firing acceleration of more than 10,000 g's. More preferably, the munition experiences a launch or firing acceleration of more than 16,000 g's. Still more preferably, the munition experiences a launch or firing acceleration of more than 18,000 g's. Also preferably, the munition further comprises sensors consisting of at least one accelerometer, at least one magnetometer, at least one IR sensor, at least one rate gyroscope, and also comprises at least one microcontroller configured to process signals from the sensors and provide output to control the at least one activatable flow effector. Also preferably, the munition is equipped with a video camera in the nose of the munition. Also preferably, the at least one activatable flow effector comprises a canard that extends beyond the outer radius of the munition, and the munition further comprises an activatable wing that also extends beyond the outer radius of the munition. Usefully, the canard's angle of attack may be modified after deployment by a beveled geared reduction mechanism located inside of the munition body.

Still other embodiments of the present invention comprise a munition comprising a munition body having a forebody and an afterbody, at least one deployable fin on the afterbody, and at least one deployable flow effector on the forebody, wherein the at least one deployable fin is deployed after the munition's launch or ejection and the at least one deployable flow effector is subsequently deployed to affect air flow over the at least one deployable fin, thereby both extending the range and increasing the precision of the munition. The at least one deployable flow effector on the forebody may be a spoiler or a canard. Preferably, the canard is actuatable so that the canard's angle of attack may be modified after deployment by a beveled geared reduction mechanism located inside of the munition body. The munition is preferably a tank round, mortar round, artillery round, or grenade.

Still other embodiments of the present invention comprise a munition comprising a munition body having a forebody and an afterbody, at least two deployable dihedral wings on the munition body, and one or more deployable canards on the forebody, wherein the wings are deployed after the munition's launch or ejection and the one or more deployable canards are subsequently deployed to lift the forebody with respect to the afterbody and achieve a desired glide ratio, thereby increasing both the range and the precision of the munition. In some such embodiments, the deployable dihedral wings' angles of attack are advantageously independently modified after deployment by a beveled gear reduction mechanism located inside of the munition body. Likewise, the canards' angles of attack may be independently modified after deployment by a similar type beveled gear reduction mechanism located inside of the munition body. The munition may be a tank round, a mortar round, an artillery round, or a grenade.

Yet another embodiment of the present invention is a method of increasing both the range and the precision of a munition comprising firing or launching the munition having a forebody and an afterbody from a short, smooth-bore barrel, deploying at least two deployable dihedral wings on the munition body, deploying one or more deployable canards on the forebody, independently adjusting the angle of attack of the wings and canards using a geared transmission located inside of the munition body to stabilize the munition to eliminate spin and lift the munition forebody with respect to the afterbody. Both the range and the precision of the munition are increased by the deployment and adjustment of the at least two wings and one or more canards. A variation of this method would be to omit the deployment and use of wings. This method may be applicable to several kinds of munitions fired or launched at various high-g accelerations, e.g., a 40 mm grenade that experiences at least about 18,000 g's when fired or launched, or a mortar round that experiences at least about 10,000 g's when fired or launched, or a tank round that experiences at least about 10,000 g's when fired or launched.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention and together with the description serve to explain the principles and operation of the invention.

DETAILED DESCRIPTION OF THE INVENTION

The active canard system of some embodiments of the present invention works to extend range and precision of the round, assisting in self-righting the round and stabilizing the flight trajectory as well as providing the required actions to extend the range of the round and/or maneuvering towards the target. Some embodiments further have deployable lifting surfaces or wings placed at dihedral angles which function to self-right the round and enable it to glide stably.

Then, the active canard system may focus on adjustments to extend range through a pitch up maneuver. In the event the dihedral angle does not self-right and/or does not provide stable flight, the active canards actuate in a manner to self-right and fly stably through validation and feedback from the disclosed sensor suite.

Figure 1A:
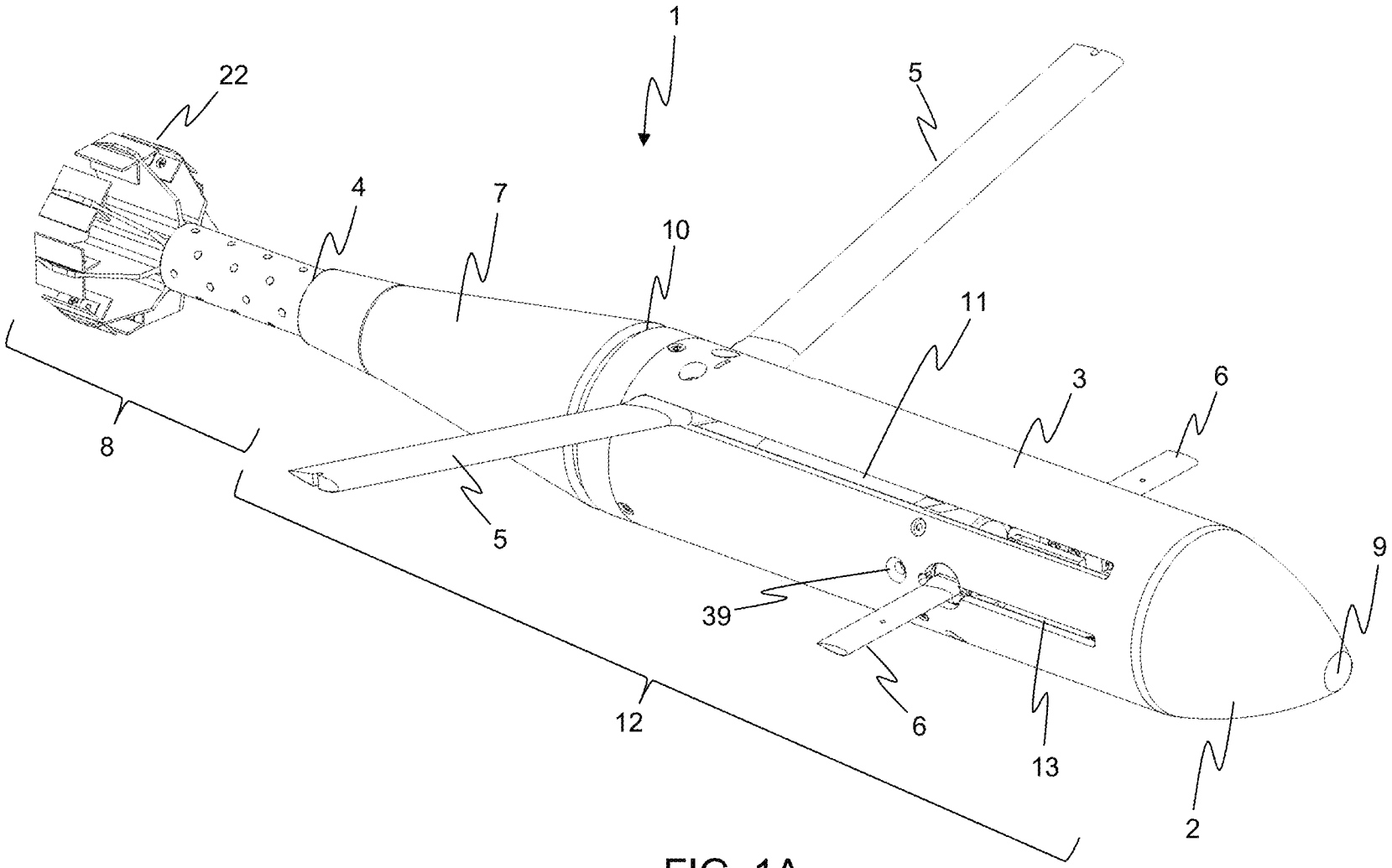
FIG. 1A. 120 mm mortar round embodiment of the present invention having deployable wings and canards.
Figure 1B:
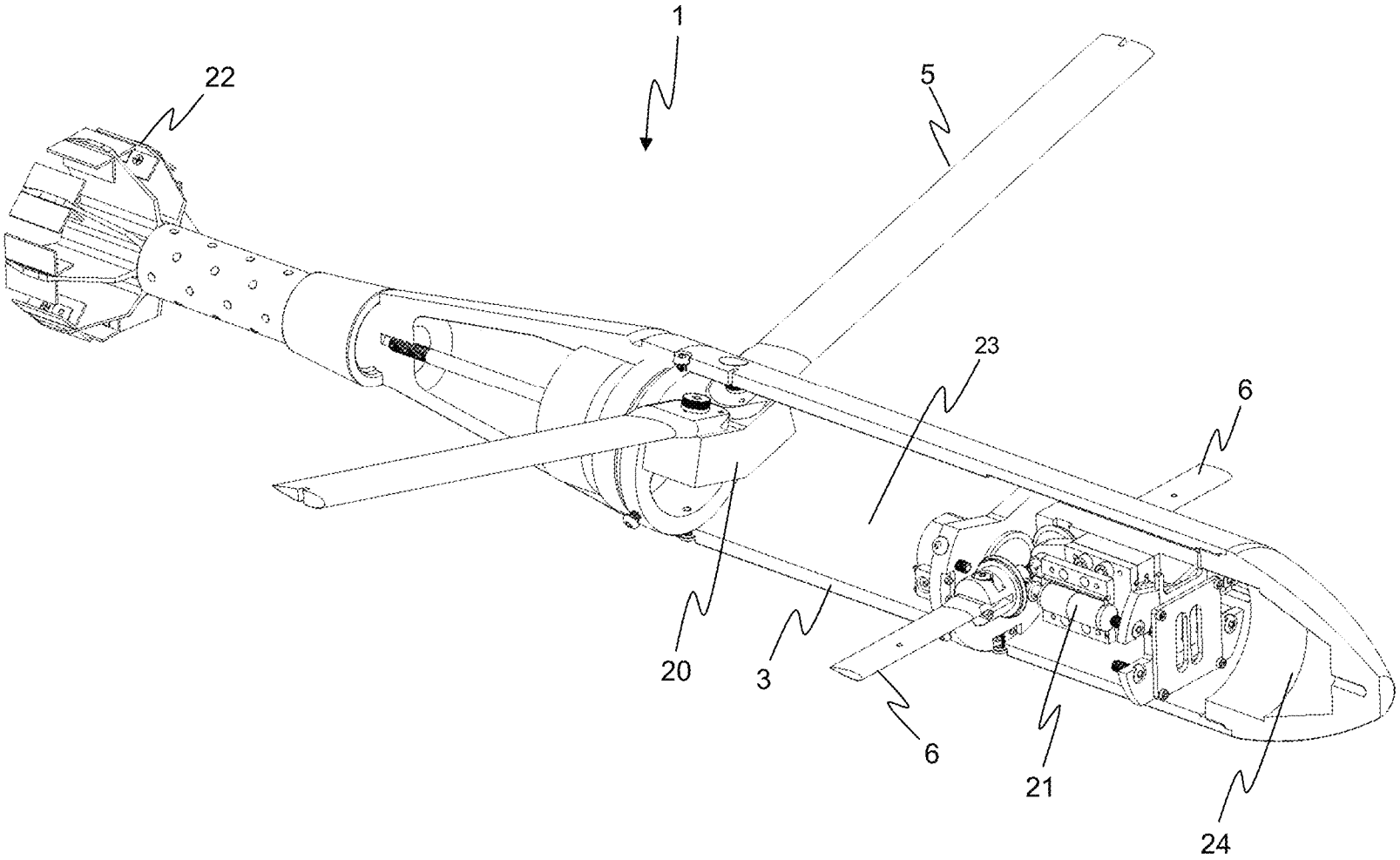
FIG. 1B. Cutaway view of 120 mm round embodiment of the present invention having deployable wings and canards.
Figure 1C:
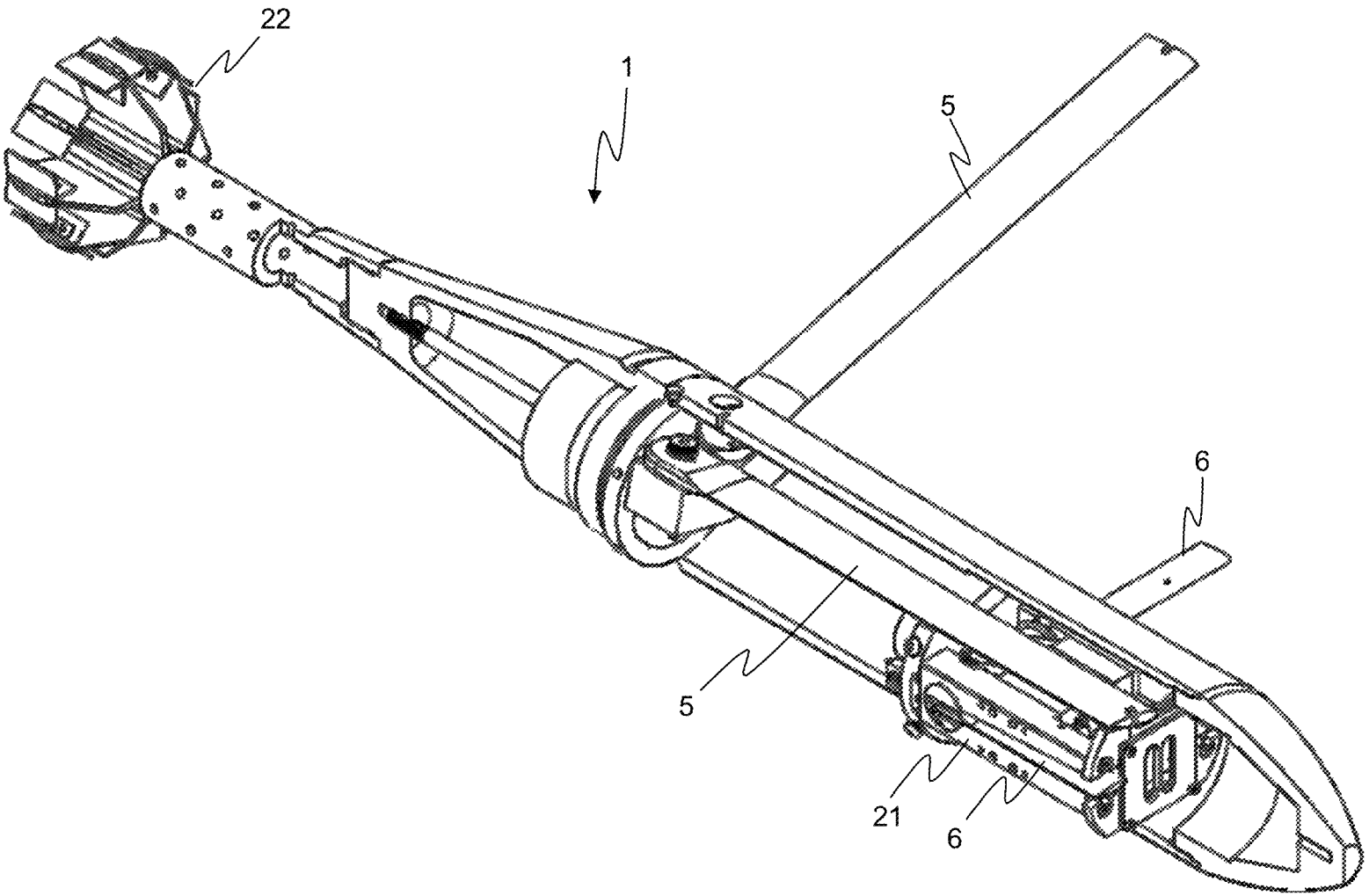
FIG. 1C. Cutaway view of 120 mm round embodiment of the present invention having deployable wings and canards, with starboard wing and canard undeployed.

FIGS. 1A-c illustrate a 120 mm mortar round embodiment of the present invention. Although a 120 mm round is shown, a person skilled in the art would appreciate that the invention could be implemented in any roughly similar size mortar round without departing from the spirit of the invention. The round 1 comprises nose section or fuze 2, body section 12, and tail fin section 8. Body section 12 in turn comprises aft cone 7 and body tube 3. Tail fin section 8 has tail fins 22 on tail boom 4. To be ready for firing, a standard issue ignition cartridge (not shown) having primer is inserted into the hollow tube part of the tail fin section 8, while one or more increment charges (also not shown), formed as "donuts," surround the outside of this tube. An obturator or gas seal o-ring (not shown) fits in obturator groove 10 on aft cone 7 near the interface between aft cone 7 and body tube 3. The illustrated embodiment has deployable dihedral wings 5 and deployable, actuatable canards 6. The nose section 2 may contain a camera or any other kind of seeker sensor (not shown) at the nose tip 9 as one of the guidance-assisting sensors. Also inside the nose section 2 may be sensors (not shown in FIGS. 1A-c) such as a global positioning system (GPS) antenna or semi-active laser (SAL) detector, etc., as well as the fuse, trigger, timer, etc. for detonation of the payload (also not shown). The two dihedral wings 5 are deployed through two wing slots 11 and the two canards are deployed through canard slots 13.

As seen in FIG. 1B, which is a cutaway view of the 120 mm round embodiment illustrated in FIG. 1A, the wing bulkhead 20 houses the wing deployment system, and both that and the canard deployment and actuation system 21 can be seen in the hollow inside of body tube 3. The remainder of the space 23 in body tube 3 is for the payload (not shown), e.g., explosive material. As mentioned previously, hollow space 24 in nose section 2 may supply room for fuse a camera system (EO/IR), a GPS antenna, a semi-active laser (SAL) seeker, a millimeter wave (MMW) seeker.

FIG. 1*c* shows a cutaway view similar to that shown in FIG. 1B but with the starboard wing 5 and canard 6 undeployed to show how they are stowed in the body tube 3 prior to deployment, and with the canard deployment and actuation system 21 not cut away.

Preferably, the two wing slots 11 are isolated or separated from each other so that air does not flow laterally through the body tube 3 of the round 1, which cross flow may cause the round to spin or become unstable. This isolation can be achieved in a number of ways; for example, with an elastomeric bladder or rubber (not shown) or with a vertical rib (not shown) that could take the form of a steel I-beam placed down the middle of the body tube 3, which can be of a T shape with a perpendicular section towards the rear and the front bolted to another plate in the nose. This vertical rib would also add reinforcement to the upper surface of the round, which may experience a large bending force during firing, thus preventing potential failure.

An aluminum alloy such as 7075-T6, which has a yield strength of 500 MPa is preferably used for body tube 3. If a 6061 aluminum grade is utilized, a tube may be machined to create the body tube 3 of the round; otherwise a solid slab of 7075 aluminum may be utilized, requiring "hogging" out the center, a much more expensive and time-consuming process. Safety margin may be maximized in the design of the body tube 3 through the performance of structural analysis via finite element analysis (FEA) to evaluate the likelihood of failure.

Wings 5 may be made of aluminum 2024 or any other suitable material known in the art.

Figure 2:
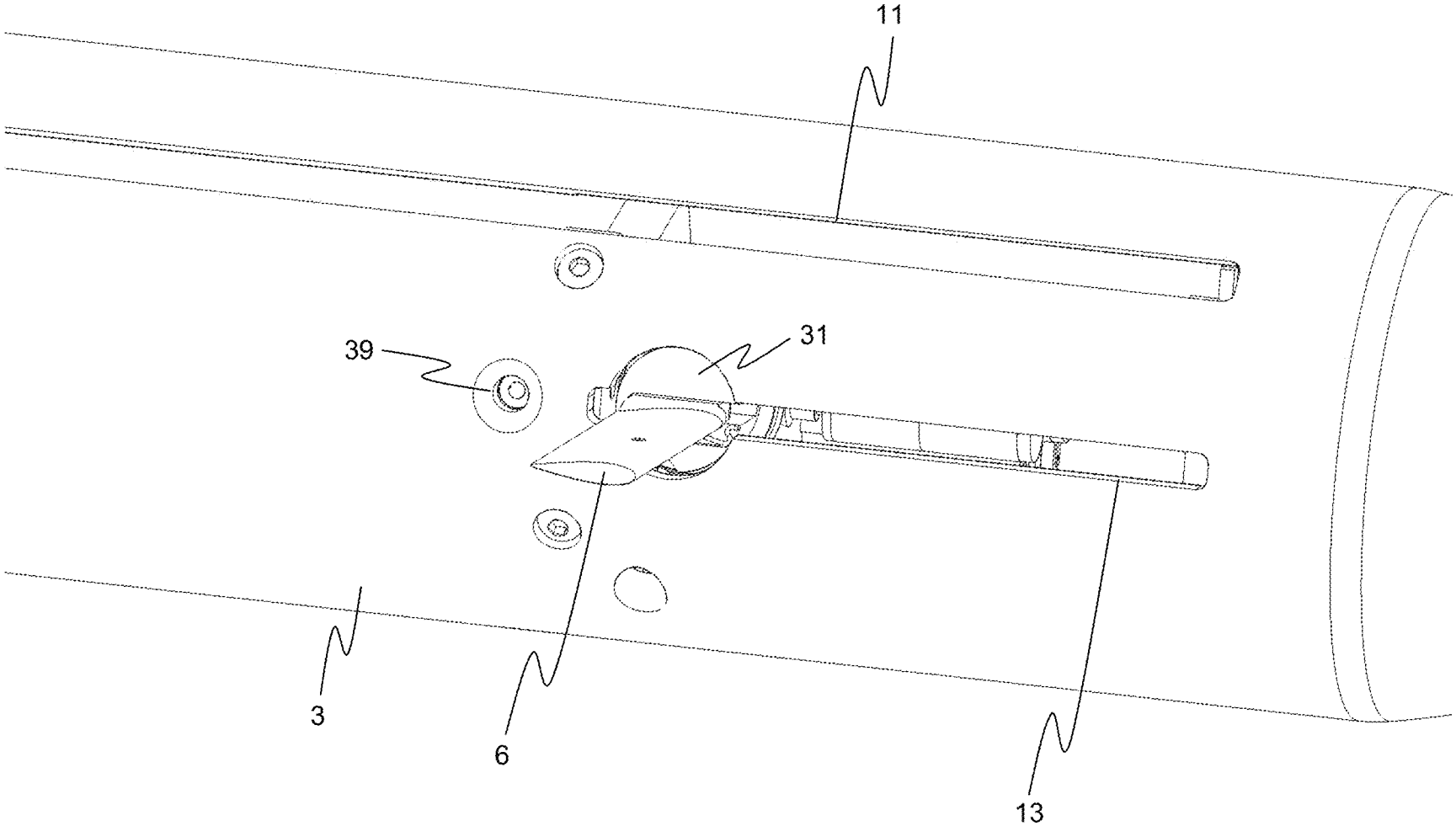
FIG. 2. Exterior view of the control surface deployment and actuation mechanism of some embodiments of the present invention.
Figure 3:
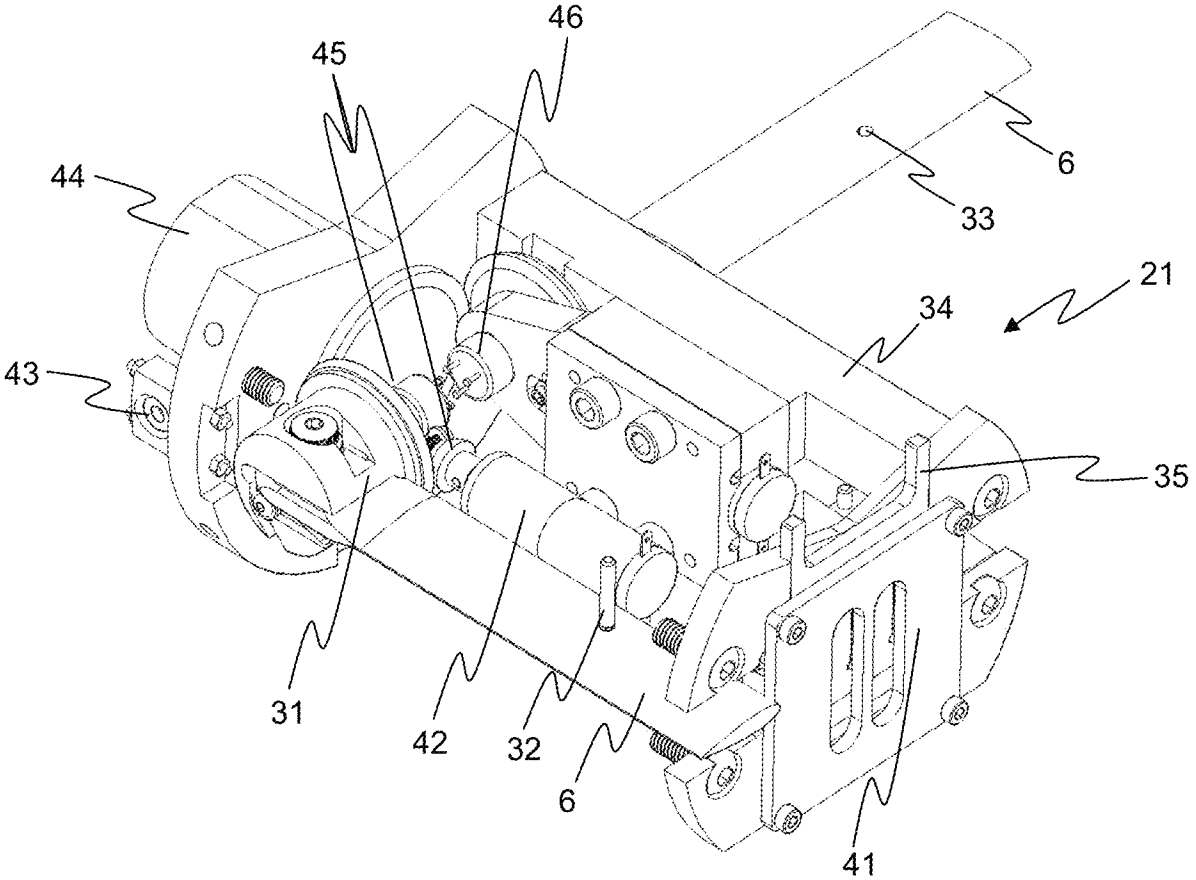
FIG. 3. Interior or cutaway schematic of the control surface deployment and actuation mechanism of some embodiments of the present invention.

FIG. 2 shows a closer exterior view of canard 6 of the 120 mm round embodiment 1 and the area of the canard deployment and actuation mechanism 21, which is shown in schematic cutaway in FIG. 3.

As can be seen in FIG. 2, canards 6 deploy through canard slots 13 and are then able to rotate via canard barrel 31. FIG. 3, a cutaway of canard deployment and actuation mechanism 21, shows that it comprises various components involved in the deployment and control of canards 6. In the illustrated embodiment, at the time of round flight when processor, located in electronic cup 44, based on inputs from various sensors, a timer, etc., determines that canards should be deployed, signal is sent from processor to actuate DC gear motor 42 which, through bevel gear and pinion 45, rotates canard barrel 31 such that tips of canards 6 are displaced downward just enough such that they come free of canard pins 32 which are fixedly embedded in frame 34 and protrude through canard pin holes 33 pre-drilled in the canards 6. These canard pins 32 hold the canards 6 stowed inside of body tube 3, but having come free of the canard pins 32 by a small displacement, canards 6 pop out by spring action. FIG. 3 shows starboard canard stowed and port canard deployed. Canard pins 32 need not protrude all the way through canards and thus canard holes 33 need not be drilled entirely through canards 33, but need only be of sufficient depth to hold the canards in place until intentionally deployed by actuating canard barrel 31. Although the deployment mechanism described permits for canard deployment with less required energy and fewer points of failure than other mechanisms, persons skilled in the art will appreciate that the canards may be deployed using other mechanisms, including by servos which actuate the canards outwards, or by using non-fixed canard pins which are actuated out of place to permit canards to pop out. Once canards are deployed, motor 42, bevel gear and pinion 45, and canard barrel 31 may actuate to rotate the canards to desired angles of attack. Potentiometer/feedback position sensor 46 provides feedback as to the angle of attack to which a canard has been rotated. Various other sensors may be incorporated into canard deployment and actuation mechanism 21, such as IR sensor 43, which looks for a heat source to tell what the orientation is of a spinning round (the sun has a larger heat signature than the ground, which has a larger heat signature than the sky).

FIG. 3 also shows wing pins 35 which fix wings 5 in place while wings 5 are stowed in body tube 3 in a similar fashion to how canard pins 32 hold undeployed canards 6 in place, by notches in the ends of wings 5 as visible in FIG. 1*c*. Wings are released, in some embodiments by spring action, when these wing pins move out of the notches. Retainer plate 41 holds these pins 35 in place so they can slide up and down.

Figure 4:
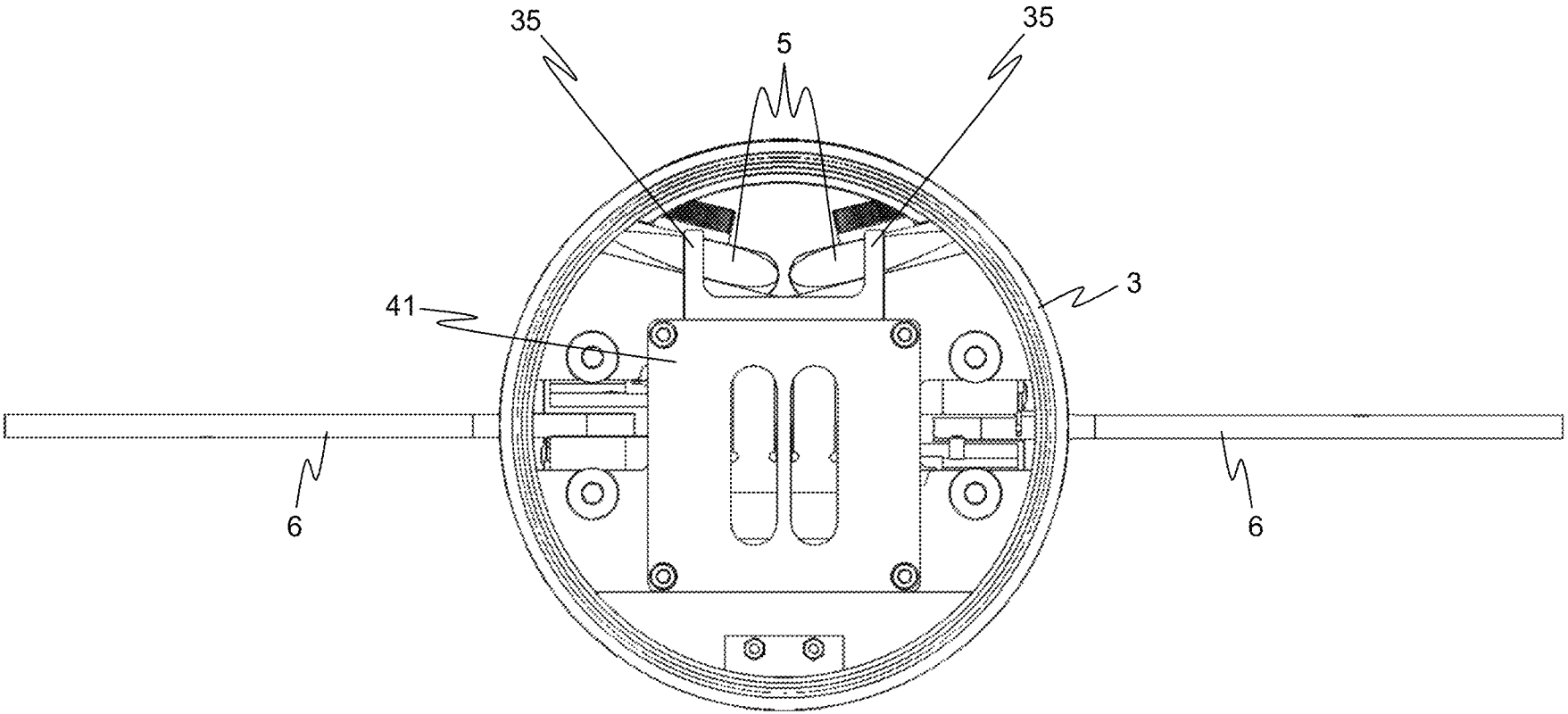
FIG. 4. View of a 120 mm round embodiment of the present invention looking down the body with the fuze removed.

Another view of the deployment and actuation mechanism 21 inside the body tube 3 is shown in FIG. 4, which looks down the body tube 3 with the nose section or fuze 2 removed. In FIG. 4, main wings 5 are stowed while canards 6 are deployed. FIG. 4 again shows retainer plate 41 and wing pins 35.

Figure 5B:
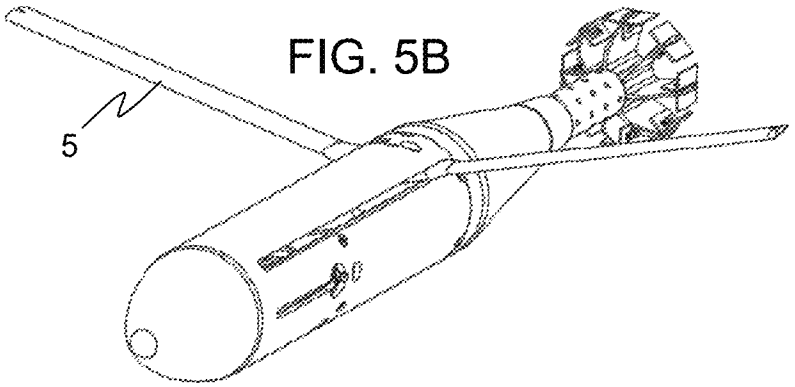
FIG. 5B. Wing-only configuration of a mortar round embodiment of the present invention with wings deployed to stabilize the spin of the mortar round, but no canards deployed.
Figure 5D:
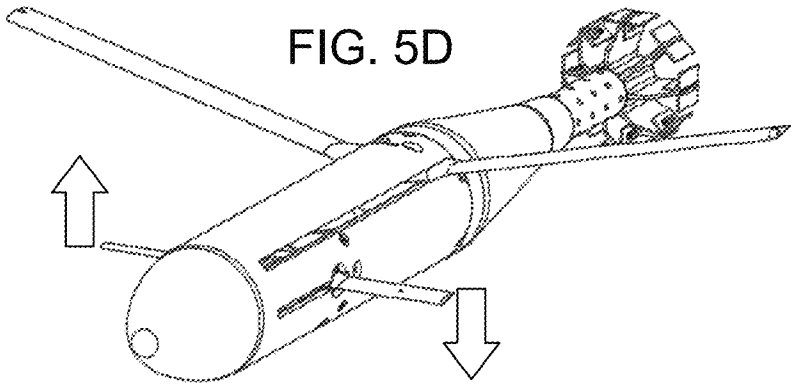
FIG. 5D. Course-correction configuration of a mortar round embodiment of the present invention with wings and canards deployed, and canards actuated to roll the mortar round in flight and thus redirect its course.
Figure 5A:
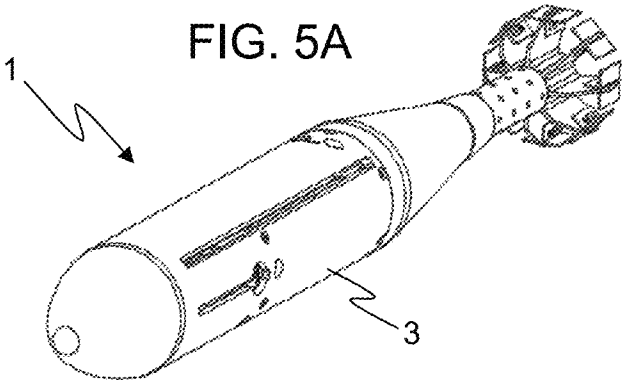
FIG. 5A. Baseline configuration of a mortar round embodiment of the present invention with no wings or canards deployed.

The canard-based system shown in the preceding figures preferably uses actuators and aerodynamic surfaces to maneuver the round, a sensor suite to identify round state and orientation (i.e., an up-finding sub-system), and a mission computer to process the guidance and control (G&C) information into commands for the actuators while monitoring the impact on the round orientation all while maneuvering towards the target and/or extending range. At firing/launch, the round 1 of the previous figures is configured as shown in FIG. 5A.

Figure 5C:
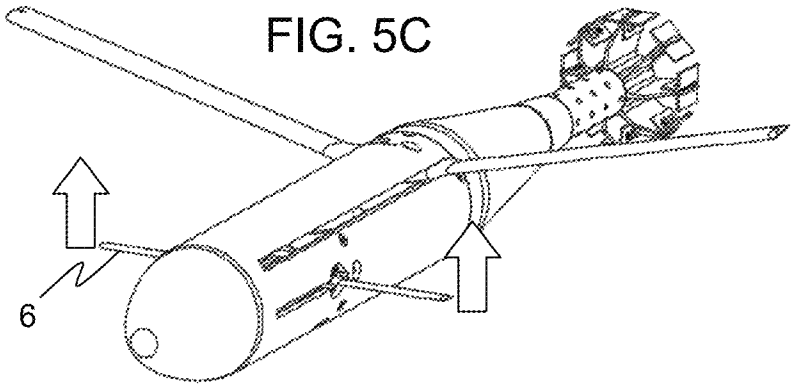
FIG. 5C. Pitch-up configuration of a mortar round embodiment of the present invention with wings and canards deployed, and canards actuated to pitch the nose of the mortar round up in flight.

This is the "baseline" configuration resembling the conformation of the traditional mortar round. Drag is minimized with no obtrusive control surfaces for most or all of the ascent phase of flight, which is also known as the boost phase. It is imperative to keep the profile or form drag to a minimum during this phase. During this time, although the round is launched from a smooth-bore mortar barrel, it will most likely nevertheless have some spin to it owing to small variances and imbalances in the round, wind conditions, etc. The round may thus be rotating at perhaps in the range of 0.5 to 5 Hz. After some time, just prior to apogee, dihedral wings 5 are deployed as shown in FIG. 5B. The deployment mechanism may be spring or motor driven, and may be triggered by a variety of different methods. In one trigger method, the electronics unit in the round has a timer circuit programmed with a predefined time step. This time step may be pre-determined through modeling and simulation (such as 6-degrees-of-motion) prior to the actual launch. The electronics unit sends an electric signal to an electro-mechanical actuator such as a motor, solenoid, linear actuator or such, which sets in motion a combination of actuation mechanisms that release the wings. The wings are attached to torsional springs and release with a positive force. The wings 5 are capable of providing substantial lift to the round during flight. Preferably, the center of gravity of the round is closer to the nose as this is important for longitudinal static stability when compared to the center of pressure. In other words, the center of gravity should lie between the nose and center of pressure. Preferably, the dihedral angle of the wings 5 and the shape of the tail fin sections are aerodynamically optimized by methods known in the art, including wind tunnel testing and computer simulation such as computational fluid dynamics (CFD). The dihedral angle of the wings is preferably between 10 and 14 degrees. This dihedral angle of the wings adds spiral mode stability by which the round can self-right if spinning. Thereafter, canards 6 are deployed and actuated as shown in FIG. 5C, the "pitch-up" configuration, to bring the nose of the mortar round up into a gliding position, thereby enhancing the lift-generating capability of wings 5 and extending the range of the round. Finally, as shown in FIG. 5D, the course correction configuration, the canards can be actuated to roll the round and thus redirect its course.

The performance and maneuvering of the round is dependent upon the stability of the round given the selected lifting surfaces (including the selection of the dihedral angle) and the selection of the tail fins 22. The tail fins 22 need to be optimized to impart longitudinal stability. The tail fins 22 of the present invention may be of any type known in the art, including T-tabs, ring fins or deployable fins. Preferably, the base and cross section of canards 6 are defined by the NACA 0012 airfoil profile code. Preferably, the actuation system permits an adjustment of angle of attack of the canards ranging from plus or minus 90 degrees. The canard and wing configuration determine the attainable control authority under various conditions. As described above, the canard mechanism is utilized to adjust the trim angle (i.e., perform the pitch-up maneuver required for range extension), self-right the round and/or stop the round from spinning. Each canard is individually addressable. Hence, two commands are utilized to stop the round from rolling, rotate the round 180 degrees if flying upside down, and stabilize the flight trajectory.

The canard actuation system may be scaled to fit platforms ranging from 40 mm grenades to 155 mm artillery rounds.

An appropriate autonomous electronic guidance and control system is the preferred means of controlling the round's canards to guide the round towards its target ("guide to hit").

For any guided projectile to be successful it is imperative to identify the orientation of the round, especially with respect to "true-up." This will enable the actuation system to perform all the corrective maneuvers accurately to either extend range or improve precision, both of which increase lethality.

An electronics mission computer with associated sensors aids the maneuvering of the munition/round. Sensors that may be advantageously built into the round include accelerometers, magnetometers, infrared (IR) sensors, rate gyros, and motor controller sensors. A preferred sensor configuration includes at least three IR sensors, a magnetometer and rate gyros. The IR sensors are preferably located at 90, 180, 270 degrees from top to detect the horizon and earth/ground while rotating/spinning, i.e., they should be placed on both sides of the round (mid-body, near the canards) and on the underside (90 degrees apart). As these IR sensors must be exposed to the environment, holes are placed in the round body at these locations (see, e.g., IR sensor hole 39 labeled in FIGS. 1A and 2 through which IR sensor 43 in FIG. 3 may see). A person skilled in the art will appreciate that, prior to firing, any magnetometer sensor will preferably be calibrated for the local magnetic field as a routine part of any pre-firing initialization step.

Advantageously, a video camera system may also be provided in the round to sense vehicle orientation and to identify the target. The camera system may be integrated with the rest of the electronics or separated into a stand-alone package integrated into the nose of the round at 9. In embodiments utilizing a camera system, a hole is placed in the round to position the camera lens to focus through this hole. Images collected can be stored on a separate memory, e.g., an SD card or flash memory. As with other sensor data, this information may be retrieved for post-flight analysis and viewing in applications where the round is not destroyed. Preferably, the camera provides images at least 15 frames per second More preferably, the camera provides images at least 30 frames per second. More preferably still, the camera provides images at least 60 frames per second.

All sensors may be utilized to detect the orientation of the round and its spin rate. In other words, these sensors are strategically utilized to determine if the round is flying upright (or upside down), if the round is spinning, and if the round is spinning, how fast the round is spinning. The combinations of sensors are designed to provide risk reduction for providing closed loop feedback for maneuvering.

The mission computer consists of a microcontroller, preferably 32-bit or higher, several analog to digital (A/D) convertors, power converters, aforementioned sensors or sensor connectors for connecting thereto, memory storage such as an SD card or solid state drive (SSD) of suitable storage capacity (this is dictated by the sampling rate and sampling time, which is dictated by the flight time). The mission computer processes the data from the sensors, determines if all sensors are performing as expected and commands the active canards to perform a given activity for deployment or maneuvering. In some embodiments the mission computer preferably has a nonvolatile memory, e.g.

flash memory or an SD card, for storage of sensor data and MCAS commands in real time. Information stored to the memory may be useful for post-flight analysis in instances where the round is not completely destroyed (e.g. test firing or other non-explosive applications).

Embodiments of the present invention preferably also involve algorithms for range extension and guide-to-hit through closed loop feedback from the sensor suite module to command the active canards. The algorithms ensure the program will utilize the most efficient strategy to collect, process, and analyze sensor suite inputs to command the canards to perform self-righting maneuver(s), pitch-up maneuver(s) for range extension, and multiple canard positions to maneuver to target. During flight, the sensor suite is utilized to detect when the round is flying upright (or upside down) and also determine the roll rate if spinning. The sensors then command the canards to perform the appropriate action to stabilize flight. The algorithms integrate the data from all sensors to determine if any sensor is not performing as anticipated. The algorithms ensure that erroneous data is not utilized for closed loop feedback to the active canards. The relevant data extracted from the integrated data is utilized to command the active canards.

Once the sensors detect stable flight, the sensors are used to identify the onset of any roll forces that must be mitigated by the active canards. However, with the given dihedral angle of the wings and the orientation of the round based on its center of gravity, the round generally does not experience any rolling forces.

Once the round is stabilized, the mission computer commands the active canards to perform a pitch-up maneuver to extend range. The algorithms are utilized to perform a "guide-to-hit" maneuver.

To preserve the range extension and guidance capabilities of the round, the wing and canard deployment and actuation mechanisms must be capable of surviving the setback loads associated with firing/launch. Preferably, the actuators, sensors including camera(s) if any, feedback system(s), control surfaces, controllers/processors, and memory/data storage of the present invention are capable of surviving setback loads of at least 2,000 g's. More preferably, they are capable of surviving setback loads of at least 4,000 g's. Even more preferably, they are capable of surviving setback loads of at least 6,000 g's. Still more preferably, they are capable of surviving setback loads of at least 8,000 g's. Still more preferably, they are capable of surviving setback loads of at least 10,000 g's. More preferably still, they are capable of surviving setback loads of at least 16,000 g's. Most preferably, they are capable of surviving setback loads of at least 18,000 g's. When the munition/round experiences setback, it is preferable for all the moving components to be completely supported along the axis of travel to prevent failure. In the present design, all movable components such as motors and gears have been completely supported to ensure very little to no movement at setback. The canards are seated in a slot and are held in place by pins to ensure no movement under setback loads. The motors, which are preferably commercially available off the shelf (COTS) components, are mounted such that the motor shaft is supported to ensure minimal movement (almost no movement) under setback.

Feedback electronics resolve the exact position of the canards in flight. Preferably, the feedback system uses a potentiometer or encoder (magnetic or optical) to determine the rotation of each canard. A potentiometer is a variable resistor, which when used as a transducer helps in building a feedback loop with an actuator—in this case, a motor. By correlating the position of the viper (third/moving element of the potentiometer) with resistance, the rotational position of the canard can be determined. The potentiometer is coupled to the motor through the bevel gears. An encoder is a transducer that can sense rotary position to an electronic signal. By coupling the encoder with the motor shaft, the position of the motor/canard can be ascertained and close the feedback loop. Use of an encoder is preferable.

Figure 6:
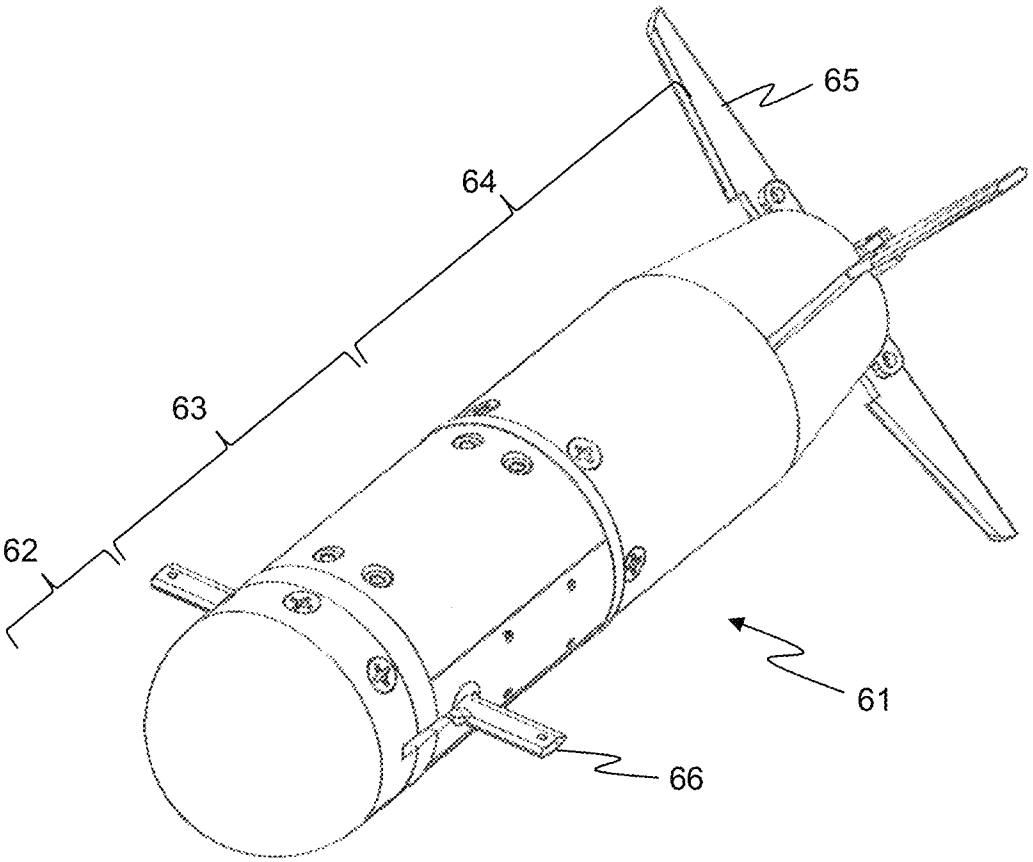
FIG. 6. Exterior view of a 40 mm grenade round embodiment of the present invention having deployable canards.
Figure 7:
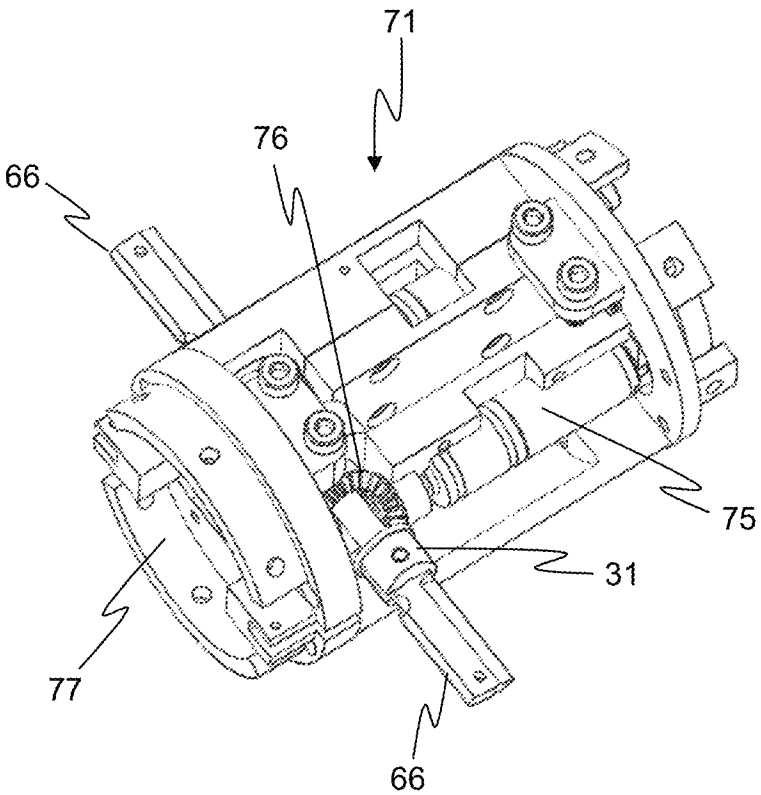
FIG. 7. Interior or cutaway schematic of the control surface deployment and actuation mechanism of a 40 mm grenade round embodiment of the present invention having deployable canards.

FIGS. 6 and 7 illustrate a 40 mm grenade round embodiment of the present invention. Grenade round 61 comprises three basic sections. Nose section 62 preferably houses various sensors including one or more of a SAL seeker, EO/IR camera, MMW radar, and GPS. Actuation section 63 houses the canard deployment and actuation mechanism 71 and electronics package (not shown) including sensors, processing electronics, and battery. Aft section 64 houses the payload/warhead such as high explosives or shape charge, and has deployable fins 65 attached to it as well. In the illustrated embodiment, the total length of grenade round 61 is approximately 6.5 inches. Preferably, a cup or sabot is not used to contain fins 65 as it may pose a danger upon firing.

The front-folded canards 66 are preferably located about 1.5 inches from the tip of the nose 62, slightly before the front obturator. When undeployed they may be folded in at 90 degrees or at a greater angle, e.g., 110 degrees, so as not to stick out of a von Karman nose shape when undeployed.

The structure of the 40 mm active canard deployment and actuation mechanism 71, shown in FIG. 7, is similar to that of the 120 mm round described earlier. The steering system of the 40 mm round 61 likewise uses similar or the same sensors, processor and motor controllers as the 120 mm round. Although a 40 mm round is shown, the invention could conceivably be implemented in many round sizes without departing from the spirit of the invention. As before, the illustrated embodiment has deployable, actuatable canards 66 that function much like the canards 6 of the 120 mm embodiment described above. As before, the nose section 72 may contain a camera (not shown) at the nose as one of the guidance-assisting sensors. Also inside the nose section 72 may be sensors (not shown) such as a GPS antenna or semi-active laser (SAL) detector, etc., as well as the fuse, trigger, timer, etc. for detonation of the payload (also not shown).

The various actuators (D.C. motors 75, bevel gear/miter gear 76), sensors (including camera, accelerometers, magnetometers, IR sensors, rate gyros, motor controllers, etc.), feedback system, microcontroller, and memory/data store in the grenade embodiment 61 all operate similarly to what has previously been described for the mortar round embodiment 1. While a potentiometer was preferably used in the mortar round embodiment, an encoder, and preferably an optical encoder rather than a magnetic encoder, is used to detect the canard angle of attack. This is because an encoder is an integral part of the motor/gear, whereas a potentiometer introduces some slack into the system of which it is an external source. Also preferably, in the grenade embodiment, the position sensor is included in the DC gear motor 75 rather than as part of the canard barrel 31.

The typical 40 mm grenade round has a launch velocity of 100 meters per second and a launch impulse of 15,000 g's. To preserve the range extension and guidance capabilities of the round, the canard deployment and actuation mechanisms must be capable of surviving the setback loads associated with firing/launch. Preferably, the actuators, sensors including camera(s) if any, feedback system(s), control surfaces, controllers/processors, and memory/data storage of the present invention are capable of surviving setback loads of at least 2,000 g's. More preferably, they are capable of surviving setback loads of at least 4,000 g's. Even more preferably, they are capable of surviving setback loads of at least 6,000 g's. Still more preferably, they are capable of surviving setback loads of at least 8,000 g's. Still more preferably, they are capable of surviving setback loads of at least 10,000 g's. More preferably still, they are capable of surviving setback loads of at least 16,000 g's. Most preferably, they are capable of surviving setback loads of at least 18,000 g's. Various improvements permit all the relevant components and subsystems to survive the setback loads seen at launch or at the gun-fire event.

The electronic components such as microcontroller, batteries, memory storage units, and all sensors (except IR sensors) are potted inside an electronic cup 44. The potting compound is made of a two-part resin and hardener pair. When hard, the potting compound creates a homogenous physical structure around the discrete electronic components, thereby not allowing them to move under the setback loads and creating the survivability required for the present invention.

The actuators such as DC motors 42, 75 or solenoids have moving parts, and it is important to ensure that the moving components such as the rotor or armature are locked or positioned such that, at launch or at setback, they do not move, or move only a very small amount, as excessive motion may damage the components on firing.

So as to reduce as much as possible the mass of the active canards system, a polymeric composite such as Garolite may be used to create the frame. Preferably, the active canard system has a mass of less than about 200 grams. More preferably, it has a mass of less than about 100 grams. More preferably, it has a mass of less than about 70 grams. Preferably, the weight of the entire 40 mm round is under 240 grams for the safety of the soldier deploying the round.

As described above and shown in the drawings, in various embodiments of the present invention, the deployable canard acts as both a lift surface and a control surface. Preferably, it is used as a lifting surface to generate lift forward of the center of gravity. Also preferably, it is also used as a control surface to maneuver the munition/round. Thus, the canard is preferably used as both a lifting surface and control surface.

Some words also need to be said to distinguish the various degrees of deployability of the flow effectors and/or control surfaces described herein. When the flow effectors/control surfaces may be deployed but not thereafter undeployed (or retracted), as is often the case when they are actuated with spring motion, they are said to be "deploy-once." When such effectors/surfaces may be adjusted by non-deployment actuation after deployment, e.g., to alter their angle of attack, even if they are unretractable, the modifier "deploy-and-adjust" applies to such effectors/surfaces.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

We claim:

1. A g-hardened munition comprising:

a forebody, an afterbody, at least one independently adjustable activatable or deployable flow effector adapted to extend the range and enhance the precision of the munition, at least one g-hardened actuator adapted to actuate and control the at least one flow effector, a g-hardened sensor suite adapted to measure orientation and spin rate of the munition, and a g-hardened microcontroller comprising an algorithm adapted to generate output commands for range extension and guidance control of the munition through closed-loop feedback from the sensor suite;

wherein the output commands of the algorithm are adapted to signal the actuator to activate or deploy, deactivate or stow, and to reactivate or redeploy the at least one flow effector during flight, and to adjust the at least one deployable flow effector while deployed or activated to adjust trim angle, reorient, and/or despin the munition in order to increase range and provide guidance control of the munition, and the munition experiences a launch or firing acceleration of more than 10,000 g's.

2. The munition of claim 1, wherein the sensor suite comprises at least one accelerometer, at least one gyroscope, and at least one infrared (IT) sensor, each sensor having a signal.

3. The munition of claim 1, wherein the munition is a munition or round from 40 mm to 155 mm in diameter.

4. The munition of claim 2, wherein the munition, or the sensor suite of the munition, further comprises a video sensor adapted to provide a signal corresponding to orientation of the munition and/or corresponding to a target to identify and track the target, and wherein the algorithm further bases the output commands on the video sensor signal.

5. The munition of claim 2, wherein the sensor suite further comprises a global positioning system (GPS) sensor having a signal.

6. The munition of claim 4, wherein the microcontroller is further adapted to determine the munition's relative position with respect to a moving target or target location, the algorithm is further adapted to output commands for guide-to-hit control and to direct the actuator to adjust the at least one flow effector to redirect the munition towards the target or target location.

7. The munition of claim 5, wherein the sensor suite further comprises a pressure sensor, shear stress sensor or inertial measurement system adapted to measure flow dynamics on a flow surface of the munition, and the flow effectors are independently adjusted based further in part on the measured flow dynamics.

8. A g-hardened munition comprising:

a forebody, an afterbody, at least two independently adjustable activatable or deployable flow effectors adapted to extend the range and enhance the precision of the munition, at least one g-hardened actuator adapted to actuate and control the at least two flow effectors, a g-hardened sensor suite adapted to measure orientation and spin rate of the munition, and a g-hardened microcontroller comprising an algorithm adapted to generate output commands for range extension and guidance control of the munition through closed-loop feedback from the sensor suite; and wherein the output commands of the algorithm are adapted to signal at least one of the g-hardened actuators to activate or deploy, deactivate or stow, and to reactivate or redeploy at least one of the at least two flow effectors during flight, and to adjust the at least two deployable flow effectors while deployed or activated to adjust trim angle, reorient, and/or despin the munition in order to increase range and provide guidance control of the munition, and wherein the munition experiences a launch or firing acceleration of more than 10,000 g's.

9. The munition of claim 8, wherein the sensor suite comprises at least one accelerometer, at least one gyroscope, and at least one infrared (IT) sensor, each sensor having a signal.

10. The munition of claim 8, wherein the munition is a munition or round from 40 mm to 155 mm in diameter.

11. The munition of claim 9, the munition, or the sensor suite of the munition, further comprises a video sensor adapted to provide a signal corresponding to orientation of the munition and/or corresponding to a target to identify and track the target, and wherein the algorithm further bases the output commands on the video sensor signal.

12. The munition of claim 9, wherein the sensor suite further comprises a global positioning system (GPS) sensor having a signal.

13. The munition of claim 11, wherein the microcontroller is further adapted to determine the munition's relative position with respect to a moving target or target location, the algorithm is further adapted to output commands for guide-to-hit control and to direct the actuator to adjust the flow effectors to redirect the munition towards the target or target location.

14. The munition of claim 12, wherein the sensor suite further comprises a pressure sensor, shear stress sensor or inertial measurement system adapted to measure flow dynamics on a flow surface of the munition, and the flow effectors are independently adjusted based further in part on the measured flow dynamics.

15. A g-hardened munition comprising:

a forebody, an afterbody, at least two independently adjustable activatable or deployable flow effectors adapted to extend the range and enhance the precision of the munition, at least one g-hardened actuator adapted to actuate and control the at least two flow effectors, a g-hardened sensor suite adapted to measure orientation and spin rate of the munition, and a g-hardened microcontroller comprising an algorithm adapted to generate output commands for range extension and guidance control of the munition through closed-loop feedback from the sensor suite;

wherein the output commands of the algorithm are adapted to signal at least one of the g-hardened actuators to activate or deploy, deactivate or stow, and to reactivate or redeploy at least one of the at least two flow effectors during flight, and to adjust the at least one deployable flow effector while deployed or activated to adjust trim angle, reorient, and/or despin the munition in order to increase range and provide guidance control of the munition, and the munition experiences a launch or firing acceleration of more than 10,000 g's, and the angles of attack of the at least two flow effectors are independently adjusted or controlled after activation or deployment by a beveled gear reduction mechanism corresponding to each flow effector located inside of the munition body.

16. The munition of claim 15, wherein the sensor suite comprises at least one accelerometer, at least one gyroscope, and at least one infrared (IT) sensor, each sensor having a signal.

17. The munition of claim 15, wherein the munition is a munition or round from 40 mm to 155 mm in diameter.

18. The munition of claim 16, wherein the sensor suite further comprises a global positioning system (GPS) sensor having a signal.

19. The munition of claim 15, wherein the microcontroller is further adapted to determine the munition's relative position with respect to a moving target or target location, the algorithm is further adapted to output commands for guide-to-hit control and to direct the actuator to adjust the flow effectors to redirect the munition towards the target or target location.

20. The munition of claim 18, wherein the sensor suite further comprises a pressure sensor, shear stress sensor or inertial measurement system adapted to measure flow dynamics on a flow surface of the munition, and the flow effectors are independently adjusted based further in part on the measured flow dynamics.

* * * * *